US007208929B1

(12) United States Patent
Rabeyrin et al.

(10) Patent No.: US 7,208,929 B1
(45) Date of Patent: Apr. 24, 2007

(54) POWER EFFICIENT STARTUP CIRCUIT FOR ACTIVATING A BANDGAP REFERENCE CIRCUIT

(75) Inventors: Xavier Rabeyrin, Aubagne (FR); Bilal Manai, Aix en Provence (FR); Maud Pierrel, Istres (FR)

(73) Assignee: Atmel Corporation, San Jose, CA (US)

( * ) Notice: Subject to any disclaimer, the term of this patent is extended or adjusted under 35 U.S.C. 154(b) by 0 days.

(21) Appl. No.: 11/405,912

(22) Filed: Apr. 18, 2006

(51) Int. Cl.
*G05F 3/04* (2006.01)
*G05F 3/08* (2006.01)

(52) U.S. Cl. ..... 323/313; 323/901; 363/49

(58) Field of Classification Search ..... 323/901, 323/313, 314; 363/49
See application file for complete search history.

(56) References Cited

U.S. PATENT DOCUMENTS

| | | | | |
|---|---|---|---|---|
| 4,999,516 | A | 3/1991 | Suter et al. | |
| 5,084,665 | A | 1/1992 | Dixon et al. | |
| 5,867,013 | A | 2/1999 | Yu | |
| 5,949,227 | A | 9/1999 | Bujanos | |
| 5,952,873 | A | 9/1999 | Rincon-Mora | |
| 6,046,577 | A | 4/2000 | Rincon-Mora et al. | |
| 6,084,388 | A * | 7/2000 | Toosky | 323/313 |
| 6,191,644 | B1 | 2/2001 | Srinath et al. | |
| 6,204,654 | B1 * | 3/2001 | Miranda et al. | 323/316 |
| 6,255,807 | B1 | 7/2001 | Doorenbos et al. | |
| 6,281,668 | B1 * | 8/2001 | Sudo | 323/299 |
| 6,300,751 | B1 * | 10/2001 | Sudo | 323/299 |
| 6,545,530 | B1 | 4/2003 | Jordan | |
| 6,593,725 | B1 * | 7/2003 | Gallagher et al. | 323/284 |
| 6,784,652 | B1 | 8/2004 | Aude | |
| 6,859,077 | B1 | 2/2005 | Huang et al. | |
| 6,998,902 | B2 * | 2/2006 | Sugimura | 327/539 |
| 7,002,331 | B2 * | 2/2006 | Sae-Ueng et al. | 323/299 |
| 7,095,215 | B2 * | 8/2006 | Liu et al. | 323/222 |
| 2002/0130707 | A1 | 9/2002 | Somerville et al. | |
| 2004/0245976 | A1 | 12/2004 | Koyasu | |
| 2005/0035812 | A1 | 2/2005 | Xi | |

FOREIGN PATENT DOCUMENTS

JP 2004362335 12/2004

OTHER PUBLICATIONS

"Reference Voltage Driver for Low-Voltage CMOS A/D Converters", Waltari et al., pp. 28-31, IEEE, 2000.

(Continued)

*Primary Examiner*—Bao Q. Vu
(74) *Attorney, Agent, or Firm*—Volpe & Koenig, P.C.

(57) ABSTRACT

A power efficient startup circuit for activating a bandgap reference circuit is disclosed. The startup circuit uses a voltage supply having a voltage level to initiate the flow of a startup current used to activate the bandgap reference circuit. When the bandgap reference circuit starts, the startup circuit slowly charges a capacitor using the voltage supply when the startup current is flowing. The startup circuit disables quiescent current when the bandgap reference circuit is activated and a voltage of the capacitor exceeds a value equal to the difference between the voltage of the voltage supply when powered on and a voltage threshold of a switching device which disables the quiescent current. The capacitor is discharged when the voltage supply is turned off.

22 Claims, 6 Drawing Sheets

OTHER PUBLICATIONS

"The Design of Band-Gap Reference Circuits: Trials and Tribulations" by Robert A. Pease, Sep. 1990 http://www.national.com/rap/Application/0,1570,24,00.html.

Lecture Notes for ELEN 689-602, "Introduction to Bandgap Reference Generators" by Fikret Dulger, Date Unknown.

"Low Area, Low Power Startup Circuit" by Kevin Aylward, Jun. 2003 http://www.anasoft.co.uk./EE/zeropowerstartup/zeropowerstartup.html.

* cited by examiner

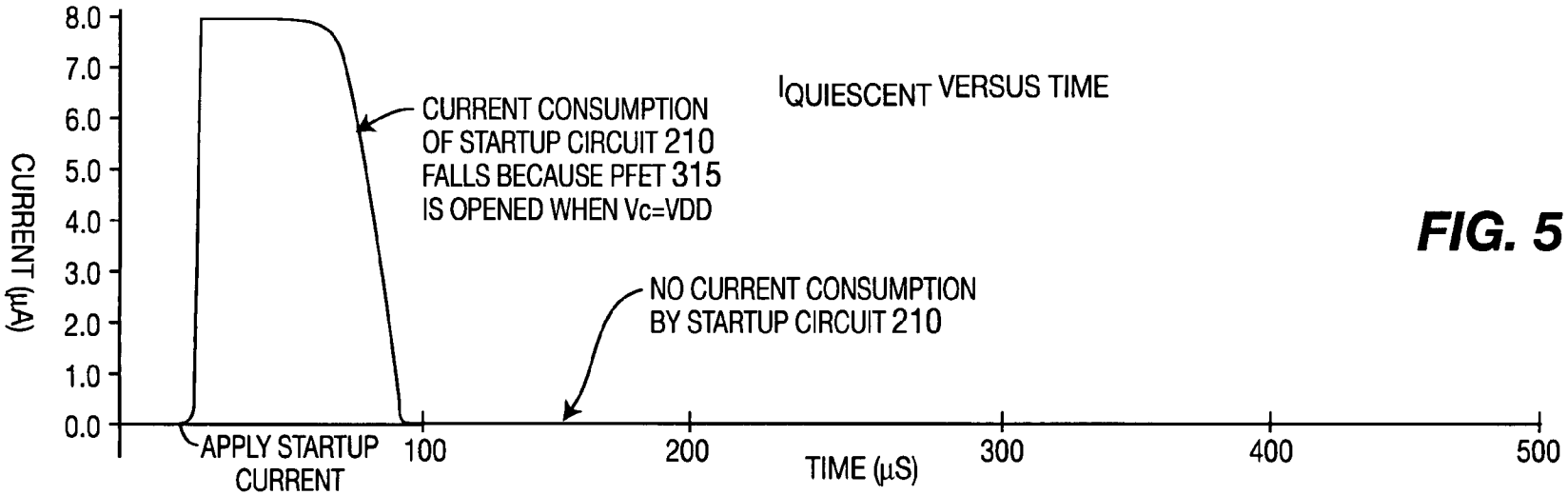
FIG. 5
$I_{QUIESCENT}$ VERSUS TIME
CURRENT CONSUMPTION OF STARTUP CIRCUIT 210 FALLS BECAUSE PFET 315 IS OPENED WHEN Vc=VDD
NO CURRENT CONSUMPTION BY STARTUP CIRCUIT 210
APPLY STARTUP CURRENT
TIME (μS)
CURRENT (μA)
8.0
7.0
6.0
5.0
4.0
3.0
2.0
1.0
0.0
100
200
300
400
500

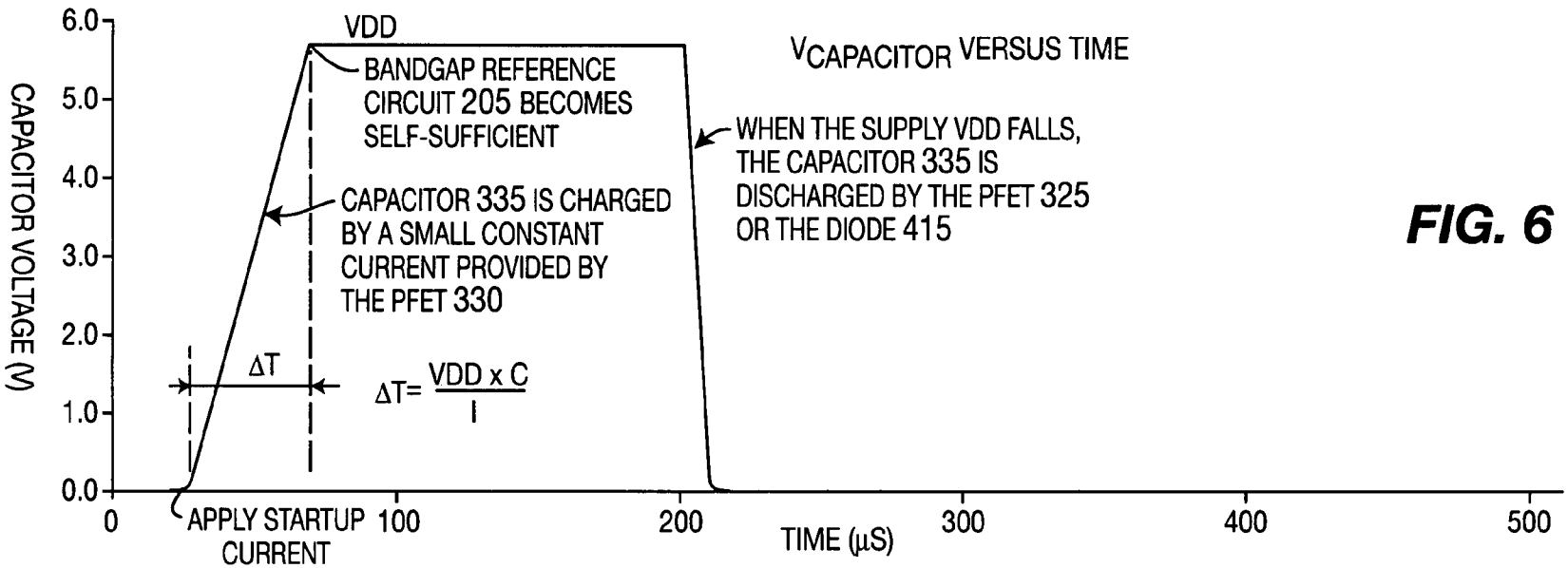
FIG. 6
$V_{CAPACITOR}$ VERSUS TIME
WHEN THE SUPPLY VDD FALLS, THE CAPACITOR 335 IS DISCHARGED BY THE PFET 325 OR THE DIODE 415
VDD
BANDGAP REFERENCE CIRCUIT 205 BECOMES SELF-SUFFICIENT
CAPACITOR 335 IS CHARGED BY A SMALL CONSTANT CURRENT PROVIDED BY THE PFET 330
$\Delta T = \frac{VDD \times C}{I}$
ΔT
APPLY STARTUP CURRENT
TIME (μS)
CAPACITOR VOLTAGE (V)
6.0
5.0
4.0
3.0
2.0
1.0
0.0
0
100
200
300
400
500

ISTARTUP VS. TIME
STARTUP CURRENT
ISTART (nA)
700
600
500
400
300
200
100
0
100
200
300
400
500
TIME (µS)

VDD VS. TIME
TURN OFF VDD
VDD
APPLY STARTUP CURRENT
VDD (VOLTS)
6
5
4
3
2
1
0
0
100
200
300
400
500
TIME (µS)

POWER EFFICIENT STARTUP CIRCUIT FOR ACTIVATING A BANDGAP REFERENCE CIRCUIT

FIELD OF INVENTION

The present invention is related to a startup complementary metal oxide semiconductor (CMOS) circuit used to startup a bandgap reference circuit. More particularly, the present invention is related to a startup circuit that disables quiescent current once the bandgap reference circuit has been started.

BACKGROUND

Portable electronic equipment including cellular telephones, pagers, laptop computers and a variety of handheld electronic devices has increased the need for efficient voltage regulation to prolong battery life. Bandgap reference bias circuits have long been used to produce reference voltages for voltage regulators and other analog cells. Such circuits typically include a bandgap reference circuit and a startup circuit.

FIG. 1 shows a schematic diagram of an exemplary conventional startup circuit 100 and a bandgap circuit 105. For this example, startup circuit 100 includes transistors 50 and 52 which are configured to produce a logic high voltage at node 54, (their common point of interconnection), whenever the feedback voltage 46 is below the threshold voltage of transistor 50. In other words, whenever the feedback voltage 46 is below the startup voltage threshold, transistor 50 will be off and node 54 will be pulled high by the action of transistor 52. Conversely, when the feedback voltage 46 reaches the threshold voltage of transistor 50, the transistor 50 turns on and pulls down the voltage at node 54. Transistor 52 is a p-channel transistor having its gate coupled to ground, and is therefore always activated. Transistor 50 is an n-channel transistor.

The conventional startup circuit 100 also includes an n-channel transistor 64 which sinks startup current 48 provided by the bandgap circuit 105 when the feedback voltage 46 is below the startup voltage threshold. Conversely, when the feedback voltage 46 is at or above the startup voltage threshold, the transistor 64 is turned off, causing the startup current 48 to cease flowing.

In conventional startup circuits, there is always a current flowing through at least some of the transistors, such as the transistors 52 and 50 in the circuit 100 of FIG. 1, which is detrimental to battery power conservation and bandgap accuracy. When the feedback voltage 46 is above the startup voltage threshold, and if width and length ratios of the transistors 50 and 52 are not well designed, it is possible that the transistor 64 is not fully turned off. Thus, a current leakage occurs which causes the improper operation of the bandgap circuit 105.

In other conventional startup circuits, the startup circuit may be disabled using an external control device. However, such conventional startup circuits do not include an internal circuit that automatically stops the startup circuit when it is no longer needed. Thus, such conventional startup circuits are disadvantageous because they require additional components which may further drain valuable battery power, even when the startup circuit is not needed.

It would be desirable to provide a startup circuit that reduces leakage current from the startup circuit to the bandgap circuit during operation, and to automatically stop current consumption in the startup circuit during periods when it is not needed by the bandgap circuit, without causing unwanted voltage fluctuations.

SUMMARY

The present invention is related to a power efficient startup circuit for activating a bandgap reference circuit. The startup circuit uses a voltage supply having a voltage level to initiate the flow of a startup current used to activate the bandgap reference circuit. When the bandgap reference circuit starts, the startup circuit slowly charges a capacitor using the voltage supply when the startup current is flowing. The time T it takes to charge the capacitor is defined by the following equation: $T=(VDD\times C)/I$, where VDD is the voltage of the voltage supply, C is the capacitance of the capacitor and I is the current used to charge the capacitor. The capacitor is discharged when the voltage supply is turned off.

BRIEF DESCRIPTION OF THE DRAWINGS

A more detailed understanding of the invention may be had from the following description, given by way of example and to be understood in conjunction with the accompanying drawings wherein:

FIG. 5 is a graphical representation of the quiescent current in the startup circuit of FIGS. 3 and 4;

FIG. 6 is a graphical representation of the voltage of a capacitor in the startup circuit of FIGS. 3 and 4;

DETAILED DESCRIPTION OF THE PREFERRED EMBODIMENTS

The present invention provides a startup circuit which activates a bandgap reference circuit coupled thereto. The present invention reduces current mismatch and current leakage in the bandgap reference circuit. The present invention automatically prevents unnecessary current consumption when the startup circuit is no longer needed by disabling quiescent current, thus extending battery life.

Figure 1:
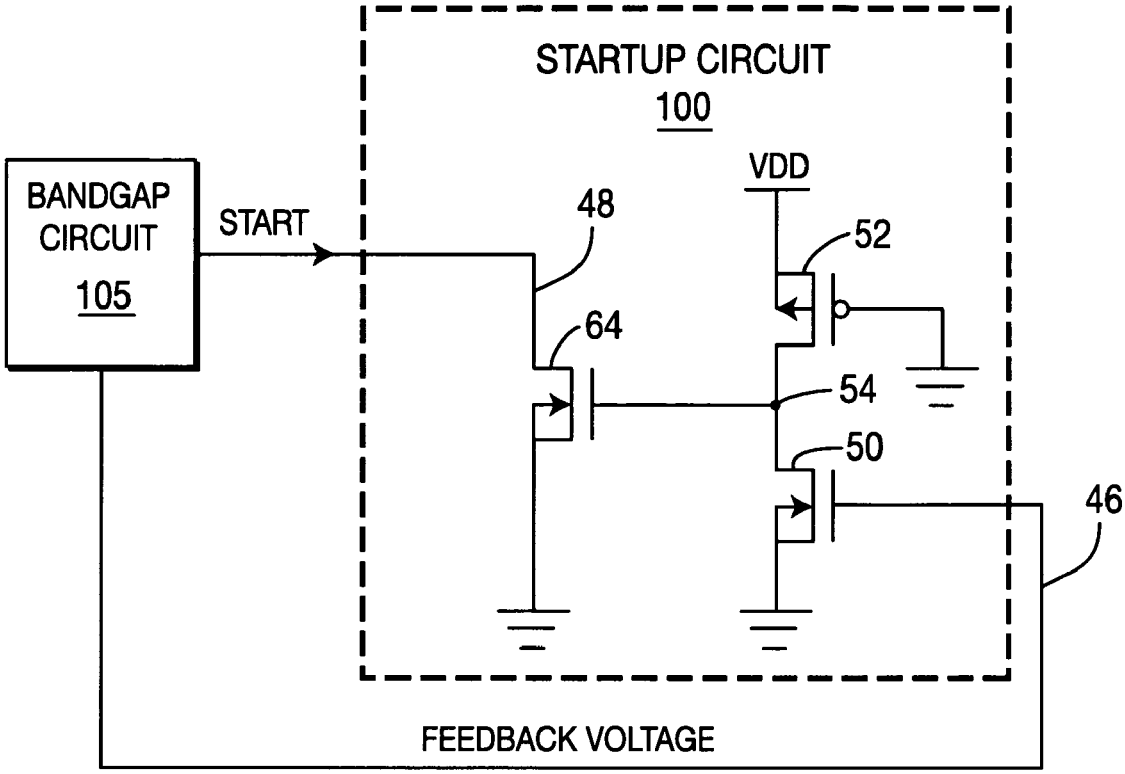
FIG. 1 PRIOR ART
FIG. 1 is a schematic diagram of an exemplary conventional startup circuit.
Figure 2:
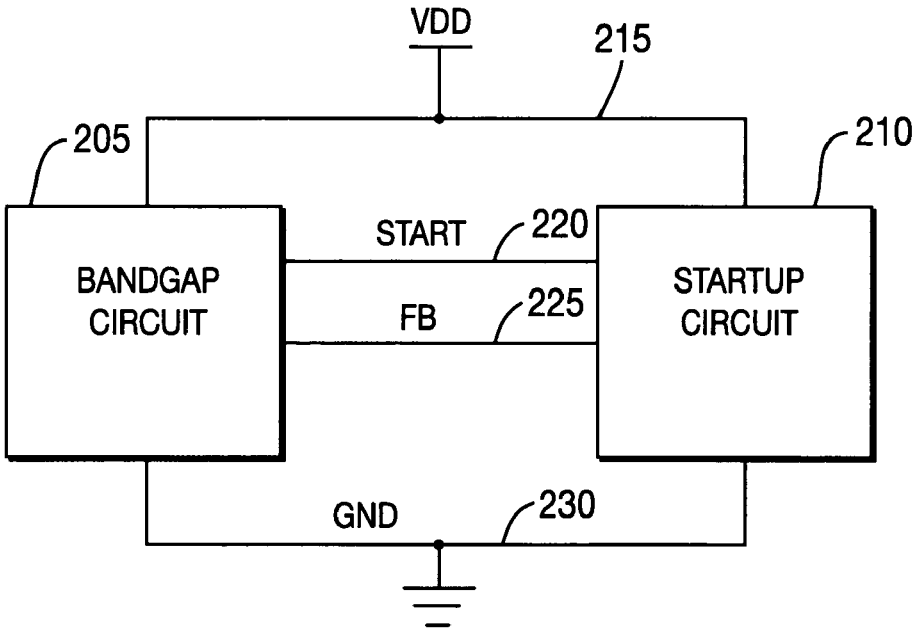
FIG. 2 shows the interface between a bandgap circuit and a startup circuit configured in accordance with the present invention.

FIG. 2 shows the interface between a bandgap circuit 205 and a startup circuit 210 configured in accordance with the present invention. The interface between the startup circuit 210 and the bandgap circuit 205 includes a startup current $I_{startup}$ 220 and feedback voltage FB 225. VDD 215 and GND 230 are commonly shared by both the bandgap circuit 205 and the startup circuit 210.

Figure 3:
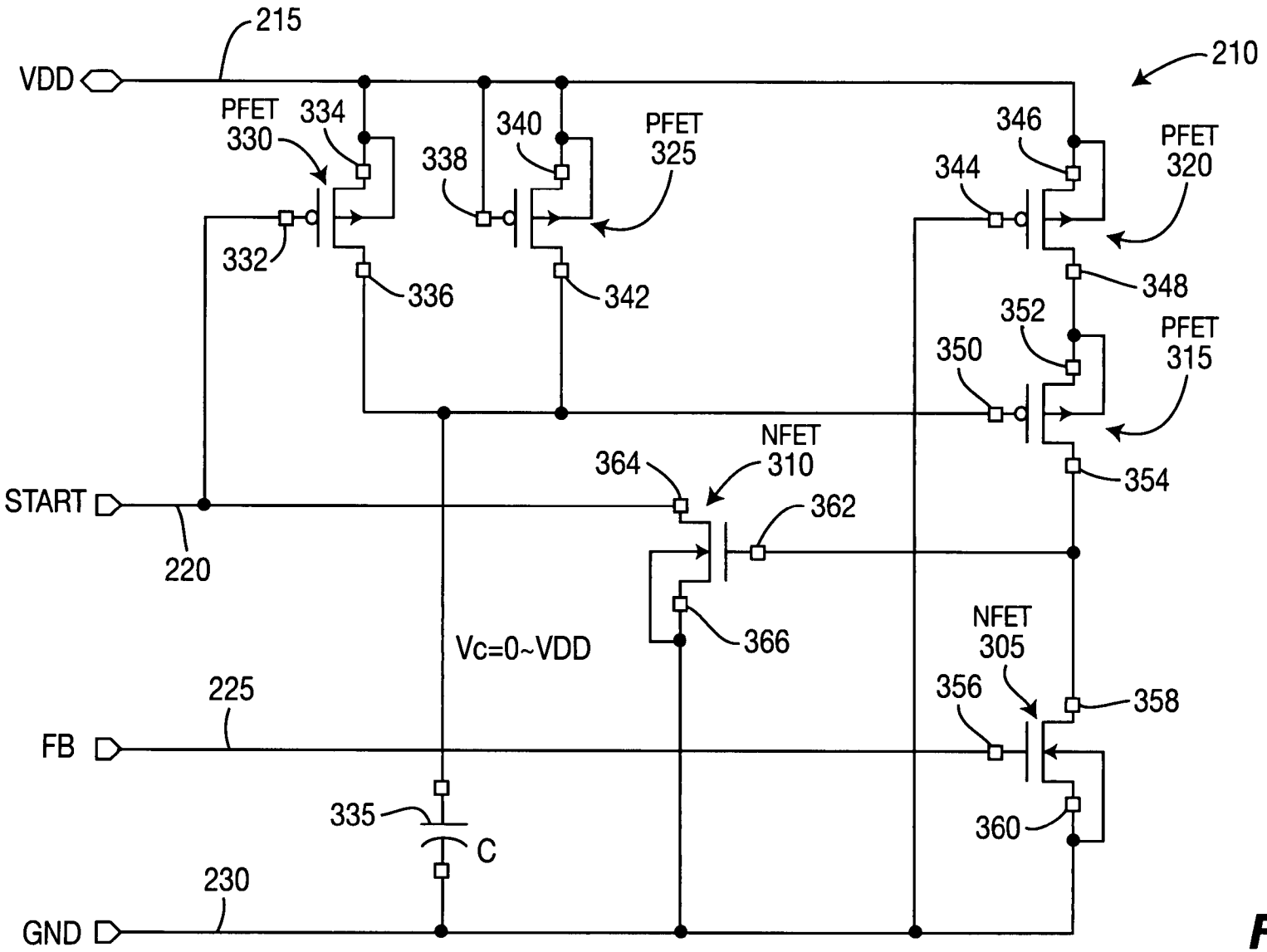
FIG. 3 is a schematic diagram of one embodiment of the startup circuit of FIG. 2.

FIG. 3 is a schematic diagram of one embodiment of the startup circuit 210 of FIG. 2. Referring to FIG. 3, the startup circuit 210 includes a plurality of transistors 305, 310, 315, 320, 325 and 330, and a capacitor 335. The transistors 305 and 310 are n-type field effect transistors (NFETs) and the transistors 315, 320, 325 and 330 are p-type field effect transistors (PFETs). The PFET 330 includes a gate node 332, a source node 334 and a drain node 336. The PFET 325 includes a gate node 338, a source node 340 and a drain node 342. The PFET 320 includes a gate node 344, a source node 346 and a drain node 348. The PFET 315 includes a gate node 350, a source node 352 and a drain node 354. The NFET 305 includes a gate node 356, a drain node 358 and a source node 360. The NFET 310 includes a gate node 362, a drain node 364 and a source node 366.

Figure 4:
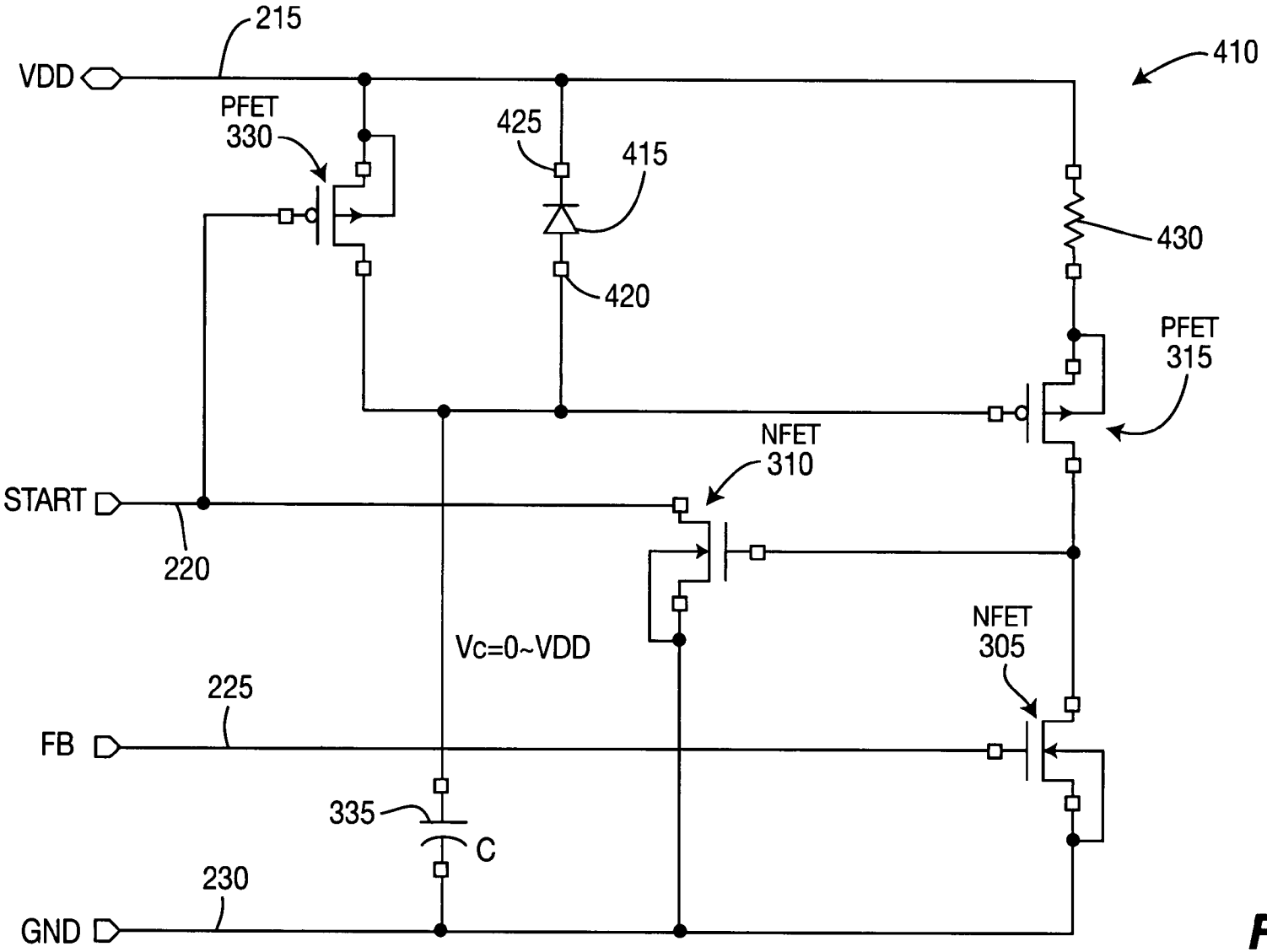
FIG. 4 is a schematic diagram of an alternate embodiment of the startup circuit of FIG. 2.

FIG. 4 is a schematic diagram of an alternate embodiment of the startup circuit 210 of FIG. 2 where a diode 415 replaces the PFET 325 and a resistor 430 replaces the PFET 320. The diode 415 includes an anode 420 and a cathode 425.

In accordance with the present invention, quiescent current flowing through the right branch of the startup circuit 210 of FIG. 3 including the PFET 320, the PFET 315 and the NFET 305, is disabled when the voltage of the capacitor 335 exceeds a value equal to the difference between VDD and VTH, (i.e., VDD−VTH), where VTH is the threshold voltage for the gate node 350 of the PFET 315. The same applies to the current flowing through the right branch of the startup circuit 410 of FIG. 4 including the resistor 430, the PFET 315 and the NFET 305.

Referring to FIG. 3, when the voltage supply VDD 215 is turned on, the voltage supply VDD 215 propagated from the source node 346 of the PFET 320, through the drain node 348 of the PFET 320, through the source node 352 of the PFET 315 and out the drain node 354 of the PFET 315 to the gate 362 of the NFET 310, thus causing the NFET 310 to close such that $I_{startup}$ 220 flows through the source node 364 of the NFET 310 and out the drain node 366 of the NFET 310 to ground, thus starting up the bandgap circuit 205. Sinking a startup current in the bandgap circuit 205 generates a voltage which is applied on the gate 332 of the PFET 330, causing the PFET 330 to be in saturation. PFET 330 slowly charges the capacitor 335 by a small current until the voltage of the capacitor 335 reaches the voltage level of the voltage supply VDD 215. The other end of the capacitor 335 is coupled to ground. When the voltage of the capacitor 335, $V_c$, exceeds the voltage level, VDD−VTH, the PFET 315 is opened, thus stopping current from flowing through the right branch of the startup circuit 210 including the NFET 305, the PFET 315 and the PFET 320.

The amount of time T it takes to charge the capacitor 335 to VDD 215 is preferably defined by the following Equation (1):

$$T=(VDD\times C)/I \qquad \text{Equation (1)}$$

where VDD is the voltage of the voltage supply 215, C is the capacitance of the capacitor 335 and I is the small current generated by the PFET 330 to charge the capacitor 335. For example, if VDD=5 volts, C=4pF and I=500 nA, T=1 μs.

The delay T' before the PFET 315 is opened is preferably defined by the following Equation (2):

$$T'=((VDD-VTH)\times C)/I \qquad \text{Equation (2)}$$

where, at the end of the delay T', the voltage of the capacitor 335 exceeds a value equal to the difference between VDD and VTH, (i.e., VDD−VTH), where VDD is the voltage of the voltage supply 215, VTH is the threshold voltage for the gate node 350 of the PFET 315, C is the capacitance of the capacitor 335 and I is the small current generated by the PFET 330 to charge the capacitor 335.

When a sufficient feedback voltage FB 225 is applied to the gate node 356 of the NFET 305, indicating that the startup circuit 210 is no longer needed, the NFET 305 grounds the gate node 362 of the NFET 310, causing the NFET 310 to open, and thus preventing the startup current $I_{startup}$ 220 from flowing. When the bandgap circuit 205 stops operating and VDD 215 falls to a ground value, the capacitor 335 is discharged through the PFET 325 of the startup circuit 210 of FIG. 3 or the diode 415 of the startup circuit 410.

FIG. 5 is a graphical representation of the quiescent current in the startup circuit 210 of FIG. 3 and the startup circuit 410 of FIG. 4.

FIG. 6 is a graphical representation of the voltage of the capacitor 335 in the startup circuit 210 of FIG. 3 and the startup circuit 410 of FIG. 4.

Figure 7:
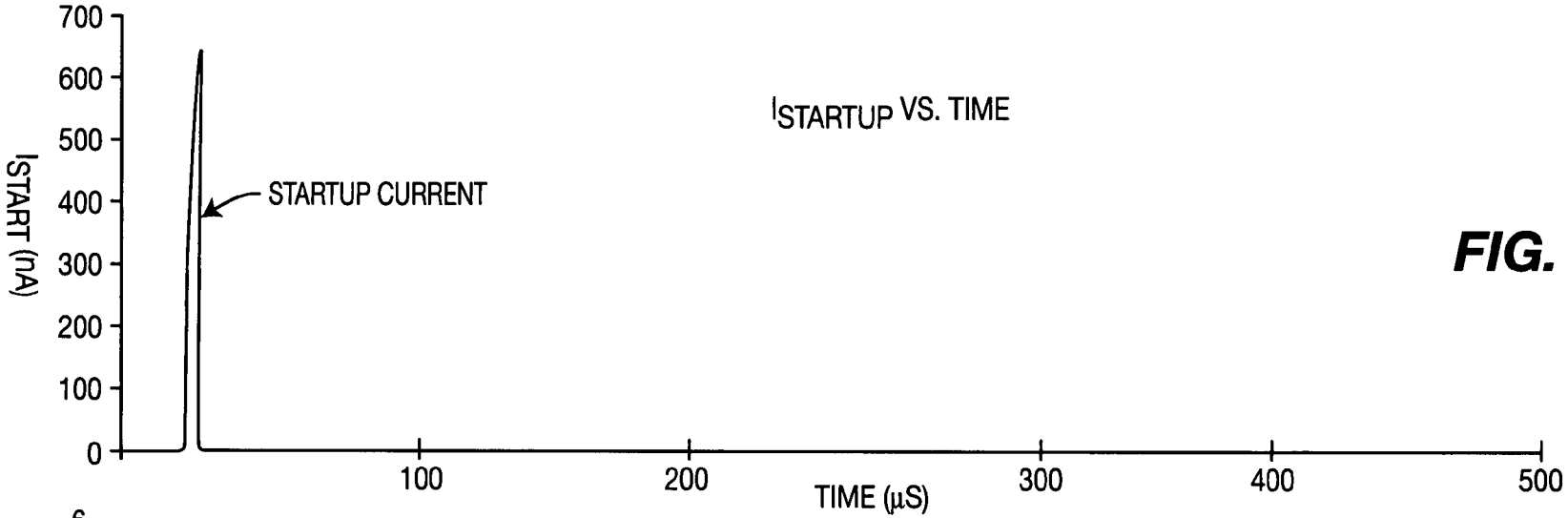
FIG. 7 is a graphical representation of the startup current in the startup circuit of FIGS. 3 and 4.

FIG. 7 is a graphical representation of the startup current $I_{startup}$ 220 versus time in the startup circuit 210 of FIG. 3 and the startup circuit 410 of FIG. 4.

Figure 8:
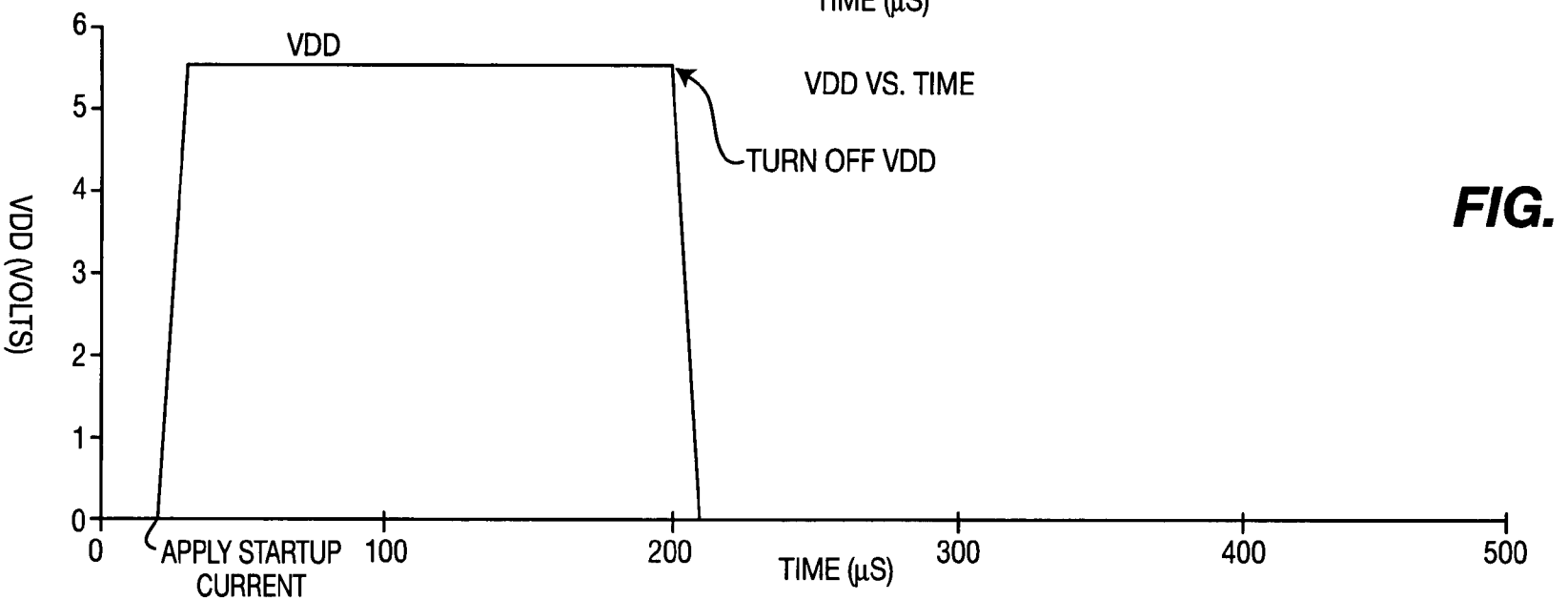
FIG. 8 is a graphical representation of the voltage supply VDD in the startup circuit of FIGS. 3 and 4.

FIG. 8 is a graphical representation of the voltage supply VDD 215 versus time in the startup circuit 210 of FIG. 3 and the startup circuit 410 of FIG. 4.

Figure 9:
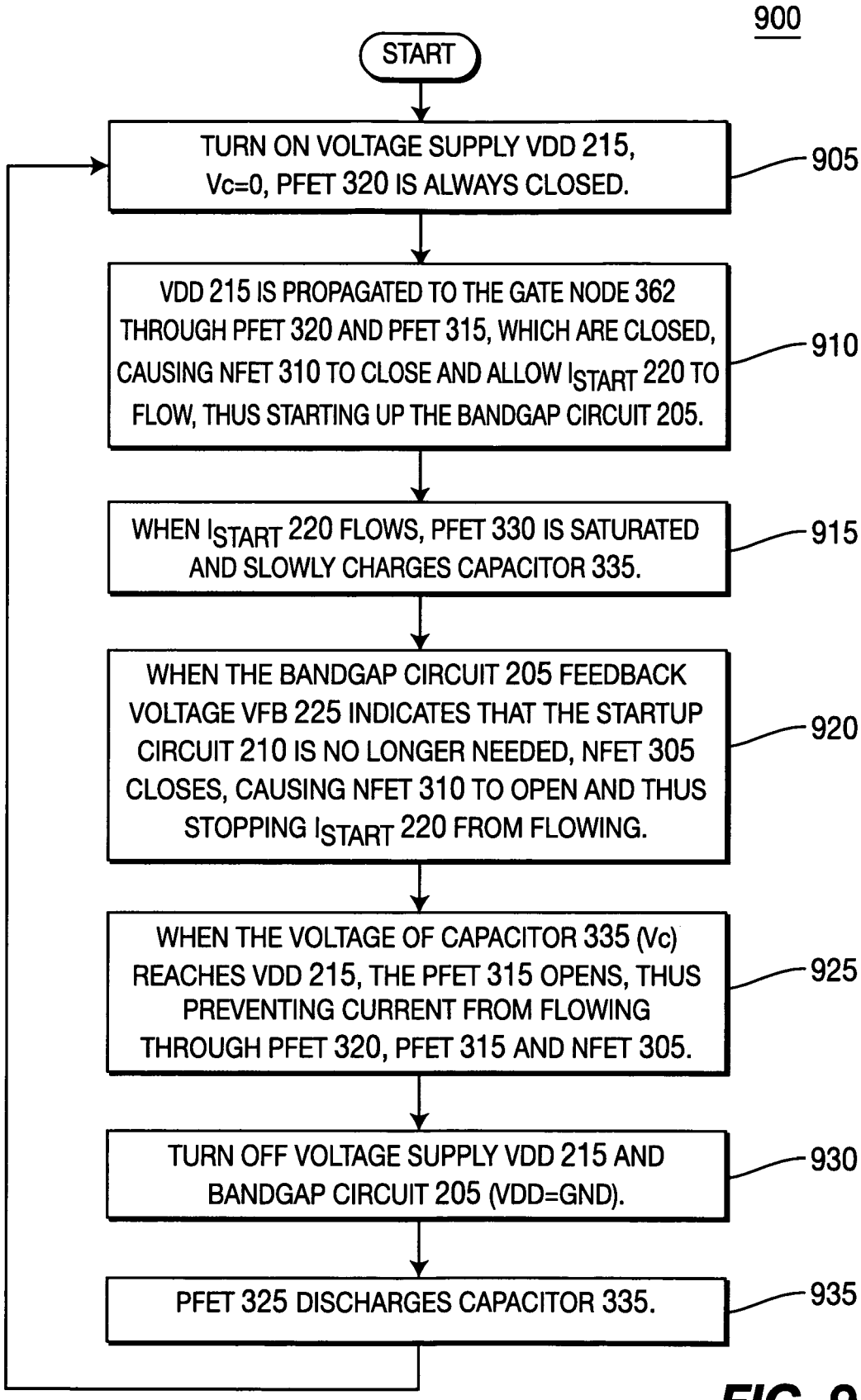
FIG. 9 is a flow diagram of a method implemented by the startup circuit of FIG. 3.

FIG. 9 is a block diagram of a method 900 implemented by the startup circuit 210. Referring to FIGS. 3 and 9, the voltage supply VDD 215 is turned on, the voltage of the capacitor 335, Vc, is zero and the PFET 320 is always closed (step 905). In step 910, the voltage supply VDD 215 is propagated to the gate node 362 through PFET 320 and 315, which are closed, causing the NFET 310 to and allow $I_{startup}$ 220 to flow, thus starting up the bandgap circuit 205. When $I_{startup}$ 220 flows, the PFET 330 is saturated and slowly charges the capacitor 335 (step 915). When the bandgap circuit 205 FB voltage 225 indicates that the startup circuit 210 is no longer needed, the NFET 305 closes, causing the NFET 310 to open and thus stopping $I_{startup}$ 220 from flowing (step 920). When the voltage of the capacitor, Vc, 335 exceeds a value, VDD−VTH, the PFET 315 opens, thus preventing quiescent current from flowing through the PFET 320, the PFET 315 and the NFET 305 (step 925). In step 930, the voltage supply VDD 215 and the bandgap circuit 205 are turned off. In step 935, the PFET 325 discharges the capacitor 335. The method 900 then returns to step 905 and repeats.

Although the features and elements of the present invention are described in the preferred embodiments in particular combinations, each feature or element can be used alone without the other features and elements of the preferred embodiments or in various combinations with or without other features and elements of the present invention.

What is claimed is:

1. A startup circuit used to activate a bandgap reference circuit, the startup circuit comprising:

(a) a first transistor having a gate node coupled to a first interconnection of an interface between the startup circuit and the bandgap reference circuit used to provide startup current to the bandgap reference circuit, a source node coupled to a voltage supply, and a drain node;

(b) a capacitor having a first end coupled to the drain node of the first transistor and a second end coupled to ground, wherein the capacitor is slowly charged by current provided by the drain node of the first transistor;

(c) a second transistor configured to discharge the capacitor when the voltage supply is turned off, the second transistor having a gate node and a source node coupled to the voltage supply, and a drain node coupled to the first end of the capacitor and the drain node of the first transistor; and (d) a third transistor having a gate node coupled to the drain nodes of the first and second transistors and the first end of the capacitor, wherein the third transistor prevents current from flowing through at least one other electrical component of the startup circuit that is not required when a voltage level of the gate node of the third transistor exceeds a value equal to the difference between the voltage of the voltage supply when powered on and a voltage threshold of the gate node of the third transistor.

2. The startup circuit of claim 1 wherein the time T it takes to charge the capacitor is defined by the following equation:

$$T=(VDD\times C)/I$$

where VDD is the voltage of the voltage supply, C is the capacitance of the capacitor and I is the current used to charge the capacitor.

3. The startup circuit of claim 1 wherein the at least one other component is a fourth transistor having a source node connected to the voltage supply, a gate node connected to ground and a drain node connected to a source node of the third transistor.

4. The startup circuit of claim 1 wherein the at least one other component is a resistor coupled between the voltage supply and a source node of the third transistor.

5. The startup circuit of claim 1 wherein the at least one other component is a fourth transistor having a drain node coupled to a drain node of the third transistor, a source node coupled to ground and a gate node for receiving a feedback voltage from the bandgap reference circuit over a second interconnection of the interface between the startup circuit and the bandgap reference circuit.

6. The startup circuit of claim 5 further comprising:

(e) a fifth transistor having a gate node coupled to the drain node of the third transistor and the drain node of the fourth transistor, a source node coupled to ground and a drain node coupled to the gate node of the first transistor.

7. The startup circuit of claim 1 wherein the first, second and third transistors are p-type field effect transistors (PFETs).

8. The startup circuit of claim 6 wherein the fourth and fifth transistors are n-type field effect transistors (NFETs).

9. A startup circuit used to activate a bandgap reference circuit, the startup circuit comprising:

(a) a first transistor having a gate node coupled to a first interconnection of an interface between the startup circuit and the bandgap reference circuit used to provide startup current to the bandgap reference circuit, and a source node coupled to a voltage supply;

(b) a capacitor having a first end coupled to a drain node of the first transistor and a second end coupled to ground, wherein the capacitor is slowly charged by current provided by the drain node of the first transistor;

(c) a diode having an anode coupled to the first end of the capacitor and a cathode coupled to the voltage supply, wherein the diode discharges the capacitor when the voltage supply is turned off; and (d) a second transistor having a gate node coupled to the drain node of the first transistor, an anode of the diode and the first end of the capacitor, wherein the second transistor prevents current from flowing through at least one other electrical component of the startup circuit that is not required when the voltage level of the gate node of the second transistor exceeds a value equal to the difference between the voltage of the voltage supply when powered on and a voltage threshold of the gate node of the second transistor.

10. The startup circuit of claim 9 wherein the time T it takes to charge the capacitor is defined by the following equation:

$$T=(VDD\times C)/I$$

where VDD is the voltage of the voltage supply, C is the capacitance of the capacitor and I is the current used to charge the capacitor.

11. The startup circuit of claim 9 wherein the at least one other component is a third transistor having a source node connected to the voltage supply, a gate node connected to ground and a drain node connected to a source node of the second transistor.

12. The startup circuit of claim 9 wherein the at least one other component is a resistor coupled between the voltage supply and a source node of the second transistor.

13. The startup circuit of claim 9 wherein the at least one other component is a third transistor having a drain node coupled to a drain node of the second transistor, a source node coupled to ground and a gate node for receiving a feedback voltage from the bandgap reference circuit via a second interconnection of the interface between the startup circuit and the bandgap reference circuit.

14. The startup circuit of claim 13 further comprising:

(e) a fourth transistor having a gate node coupled to a drain node of the second transistor and the drain node of the third transistor, a source node coupled to ground and a drain node coupled to the gate node of the first transistor.

15. The startup circuit of claim 11 wherein the first, second and third transistors are p-type field effect transistors (PFETs).

16. The startup circuit of claim 14 wherein the third and fourth transistors are n-type field effect transistors (NFETs).

17. A method of reducing power consumption in a startup circuit used to activate a bandgap reference circuit, the startup circuit including a capacitor, the method comprising:

(a) the startup circuit using a voltage supply having a voltage level to initiate the flow of a startup current used to activate the bandgap reference circuit;

(b) slowly charging the capacitor using the voltage supply when the startup current is flowing; and (c) preventing the startup circuit from drawing current from the voltage supply when the bandgap reference circuit is activated and a voltage of the capacitor exceeds a value equal to the difference between the voltage of the voltage supply when powered on and a switching device voltage threshold.

18. The method of claim 17 wherein the startup circuit includes at least one transistor coupled to the voltage supply, the transistor serving as the switching device, and step (b) further comprises:

(b1) the transistor slowly feeding current to the capacitor, wherein the capacitor is charged by the current at a rate defined by the following equation:

$$T=(VDD\times C)/I$$

where VDD is the voltage level of the voltage supply, C is the capacitance of the capacitor and I is current fed to the capacitor by the at least one transistor.

19. The method of claim 17 further comprising:

(d) discharging the capacitor when the voltage supply is turned off.

20. In a startup circuit that activates a bandgap reference circuit by using a voltage supply having a voltage level to initiate the flow of a startup current used to activate the bandgap reference circuit, a method of reducing power consumption of the startup circuit, the startup circuit including a capacitor, the method comprising:

(a) using the voltage supply to slowly charge the capacitor when the startup current is flowing; and (b) preventing the startup circuit from drawing current from the voltage supply when the bandgap reference circuit is activated and a voltage of the capacitor approaches the voltage level of the voltage supply when powered on.

21. The method of claim 20 wherein the time T it takes to charge the capacitor is defined by the following equation:

$$T=(VDD\times C)/I$$

where VDD is the voltage of the voltage supply, C is the capacitance of the capacitor and I is the current used to charge the capacitor.

22. The method of claim 20 further comprising:

(c) discharging the capacitor when the voltage supply is turned off.

* * * * *

UNITED STATES PATENT AND TRADEMARK OFFICE

CERTIFICATE OF CORRECTION

PATENT NO. : 7,208,929 B1
APPLICATION NO. : 11/405912
DATED : April 24, 2007
INVENTOR(S) : Rabeyrin et al.

It is certified that error appears in the above-identified patent and that said Letters Patent is hereby corrected as shown below:

IN THE DRAWINGS

At sheet 5, FIG. 7, vertical axis, delete "$I_{START}$ (nA)" and insert therefor --$I_{STARTUP}$ (nA)--.

At sheet 6, FIG. 9, item 910, line 3, after the word "ALLOW", delete "$I_{START}$ 220" and insert therefor --$I_{STARTUP}$ 220--.

At sheet 6, FIG. 9, item 915, line 1, after the word "WHEN", delete "$I_{START}$ 220" and insert therefor --$I_{STARTUP}$ 220--.

At sheet 6, FIG. 9, item 920, line 5, after the word "STOPPING", delete "$I_{START}$ 220" and insert therefor --$I_{STARTUP}$ 220--.

IN THE SPECIFICATION

At column 4, line 29, before the words "and allow", insert --close--.

Signed and Sealed this

Thirtieth Day of October, 2007

JON W. DUDAS
*Director of the United States Patent and Trademark Office*